United States Patent [19]

Gall

[11] 3,988,982

[45] Nov. 2, 1976

[54] HORIZONTAL PRESS

[76] Inventor: Charles Henri Gall, Pineuilh, 33220 Sainte Foy la Grande, France

[22] Filed: May 29, 1975

[21] Appl. No.: 582,408

[30] Foreign Application Priority Data

May 30, 1974 France ..... 74.18829

[52] U.S. Cl. ..... 100/107; 100/127

[51] Int. Cl.[2] ..... B30B 9/06; B30B 9/08

[58] Field of Search ..... 100/107–109, 100/110, 111, 112, 116, 121, 126–129

[56] References Cited

UNITED STATES PATENTS

| | | | |
|---|---|---|---|
| 3,207,064 | 9/1965 | Hauser-Bucher | 100/107 |
| 3,513,769 | 5/1970 | Sutter-Christ | 100/107 |

FOREIGN PATENTS OR APPLICATIONS

| | | | |
|---|---|---|---|
| 205,859 | 10/1959 | Austria | 100/127 |
| 303,381 | 11/1932 | Italy | 100/107 |
| 365,946 | 1/1963 | Switzerland | 100/107 |
| 413,599 | 12/1966 | Switzerland | 100/107 |

*Primary Examiner*—Peter Feldman

*Attorney, Agent, or Firm*—Wenderoth, Lind & Ponack

[57] ABSTRACT

The press comprises a main cage provided with a perforated cylindrical wall which may be driven in rotation by a motor and an auxiliary cage having a perforated wall integral with a plate which is movable in translation and connected to rotate with the main cage. A screw is provided and driven in rotation by a motor on which screw the hub of the movable plate is screwthreadedly mounted. The end wall of the press is rotatably mounted on the screw. When pressing, the juice flows radially through the two perforated walls.

12 Claims, 3 Drawing Figures

HORIZONTAL PRESS

BACKGROUND OF THE INVENTION

The present invention relates to horizontal presses for pressing fruit, and in particular grapes, comprising two concentric cylindrical cages, pervious to the juices of the fruit to be pressed and connected to rotate together, and a plate which is movable in translation and connected to rotate with the two cages so as to compress a mass of fruit disposed in the annular volume defined between the two cages and by a plate which is fixed in translation and opposite the moving plate.

An embodiment of such a press is described in French Pat. No. 1,234,355 which more particularly relates to a press in which the translation of the moving plate is obtained by means of three screws which are equally spaced apart and placed between the two cages and synchronized in rotation, the cylindrical wall of the two cages being made from perforated steel sheet. Owing, on one hand, to the existence of the centre cage whereby it is possible to discharge the juice placed in the centre which is the most difficult to extract, and, on the other hand, to the use of walls of perforated sheet in respect of which the ratio between apertures and total area is much higher than with any other method of construction, such a press has a certain number of advantages:

- the amount of grapes admitted is from one-fourth to one-third higher than in conventional presses owing to the high flow of the juice during the charging operation;
- the ease with which the juice issues from the press permits higher pressing rates;
- the number of operations is usually three instead of five or six;
- it is possible to press without difficulty the stalked grapes which is quite impossible on presses having a cage of bars which allows the escape of masses of material through the gaps between the bars.

However, several criticisms have been made of this press having a central juice discharge employing three screws, which are:

- from the mechanical and electrical point of view, the construction is complicated and consequently costly;
- the presence of three screws is space-consuming and they are liable to break;
- it is difficult to clean the centre cage which is only accessible in the region of the doors of the outer cage.

SUMMARY OF THE INVENTION

An object of the invention is to overcome these drawbacks and to propose for this purpose a press of the aforementioned type, wherein the inner cage, which extends through the fixed plate, is integral with the moving plate whose hub is screwed on a rotatably mounted centre screw on which screw there is journalled the end of the outer cage opposite the fixed plate, and independent driving means are provided for the screw and for both cages.

These independent means are preferably constituted by two motor-speed reducing units in each of which units the motor is a constant-speed reversible motor capable of acting as a brake. The respective kinematic chains are moreover such that the speeds of rotation of the screw and cage are different. Thus it is possible to accept 12 rpm for the screw and 10 rpm for the cage.

Owing to the fact that the screw and the cage may each be selectively held stationary by the motor-speed reducing unit acting as a brake or be freely rotatable, that is to say, neither braked nor driven in either direction by the motor-speed reducing unit, it is possible to obtain multiple combinations, that is to say, a wide range of speeds of translation of the moving pressing plate comprising the following speeds:

- upper mean speed: with the cage held stationary and the screw rotating;
- lower mean speed: with the screw held stationary and the cage rotating;
- high speed: with the cage and the screw rotating in opposite directions (about double the mean speed);
- low speed: with the cage and screw rotating in the same direction (differential speed);
- zero speed: with the cage and screw rotating together, either of the brakes being released.

It may also be mentioned that the cleaning of the centre cage presents no difficulty since this cage is almost completely outside the press when the moving plate has effected the whole of its travel in the "pressing" direction.

BRIEF DESCRIPTION OF THE DRAWINGS

The invention will be described merely by way of example in the ensuing description with reference to the accompanying drawings in which.

DETAILED DESCRIPTION OF THE INVENTION

Figure 1:
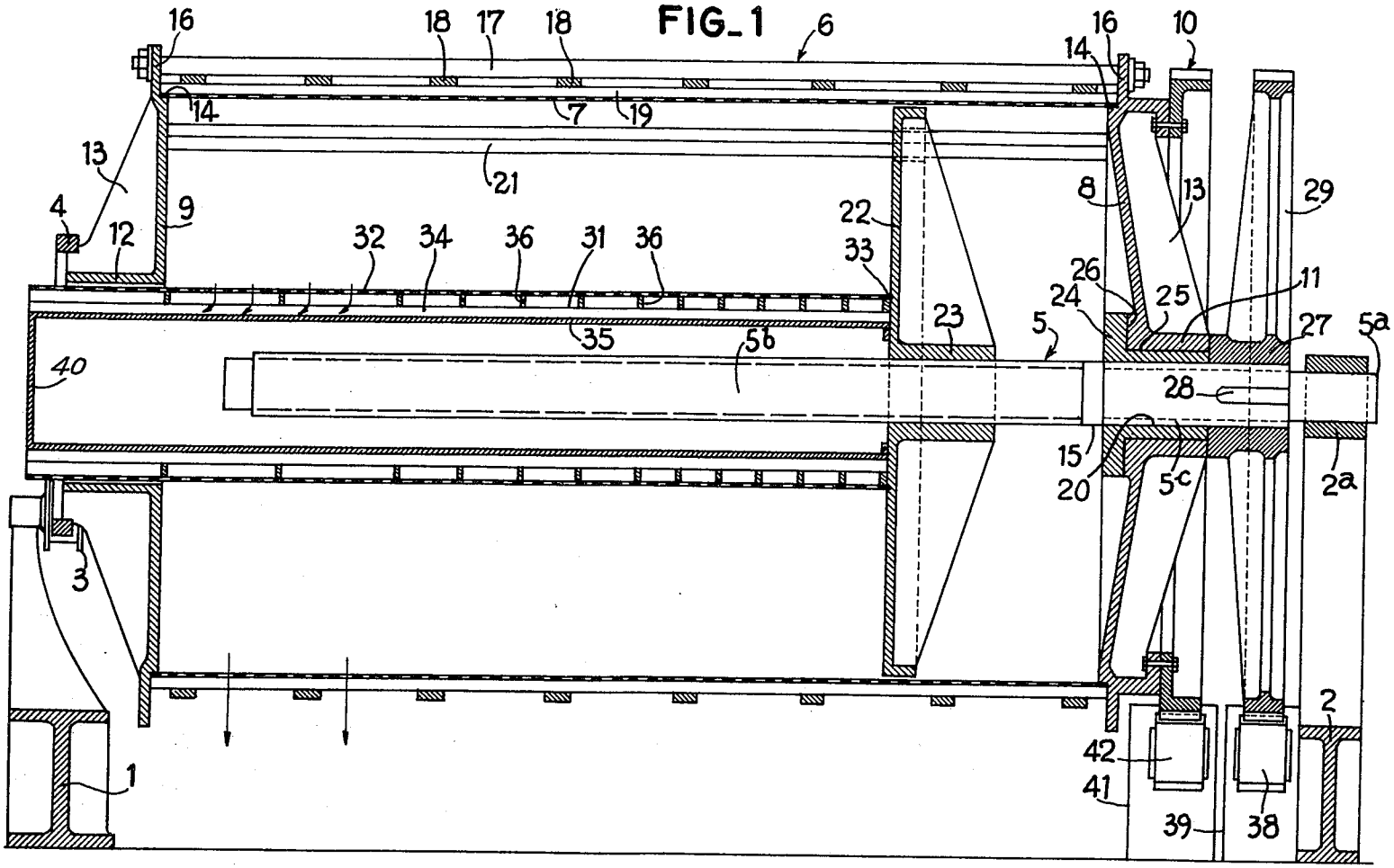
FIG. 1 is a longitudinal sectional view of a press according to the invention.

The main cage 6 of the illustrated press comprises a pervious cylindrical wall 7 formed by a perforated stainless steel sheet and supported by two end walls 8, 9 each comprising a centre hub 11, 12 and radial ribs 13. The end wall 8, which is connected with a ring gear 10 for rotating the cage 6, is carried by a centre screw 5 which is in overhanging relation has has one end $5^a$ which forms a journal engaged in a bearing $2^a$ of a support foot 2. The opposite end wall 9 has a circular runway 4 which bears on two rotary rollers 3 having double flanges mounted in the upper part of a cradle 1.

The perforated wall 7 bears at each of its ends on a cylindrical step or shoulder 14 which is formed on the inner planar face of the end walls 8, 9 and which has radially extending outwardly therefrom a flange 16. Bolted between the two flanges 16 are evenly spaced spacer members 17 which tightly engage longitudinally spaced cylindrical rings 18 in contact with radially disposed longitudinal flat metal strips in contact with the perforated sheet 7. A number of longitudinal guides 21 are secured to the inner wall of the perforated sheet 7 and slidably key a press-applying plate 22 which is movable in axial translation for pressing the fruit against the fixed plate, constituted by the end wall 9, owing to the screwing of the tapped hub 23 of the plate 22 on the screwthreaded part $5^b$ of the centre screw 5.

The moving plate 22 is moreover connected to move in translation with an auxiliary or inner cage 31 comprising a perforated cylindrical wall 32 which is of stainless steel sheet one of the ends of which is fixed at 33 to the plate 22, its other end extending in sliding contact through the hub 12 of the end wall 9. The wall 32 of the inner cage is assembled with a cylinder 35 of non-perforated sheet by flat rings 36 which are spaced apart in the longitudinal direction and fixed to the outer edge of radially disposed longitudinal strips 34 which are assembled with the outer surface of the cylinder 35. One end of the latter is connected in a fluidtight manner to the plate 33 and the other end is closed by an end wall 40 so that the cylinder 35 constitutes a sheath isolating the screw 5 from the juice while it facilitates the flow of the juice. For this purpose, the flat strips 34 define therebetween longitudinal flow passages 37.

Formed between the journal $5^a$ and the screwthreaded part $5^b$ of the centre screw 5 is another screwthreaded part $5^c$ which is separated from the part $5^b$ by a shoulder 15. Screwed on the intermediate screwthreaded part $5^c$ by its tapped bore 20 and locked in contact with the shoulder 15, is a bushing or sleeve 24 constituting by its outer cylindrical surface 25 a smooth bearing for the bore of the hub 11 and by its flange 26 a smooth thrust bearing for the adjacent end face of the hub 11, so that the end wall 8 is journalled on the sleeve 24 while it is retained axially in one direction by the thrust bearing surface 26. The end wall 8 is also retained axially in the other direction owing to the fact that the end face of the hub 11 opposite the flat bearing surface 26 is in sliding contact with the adjacent end face of the hub 27 of a gear 29 which is keyed at 28 on the part $5^c$ of the screw 5 and meshed with the output gear 38 of a motor-speed reducer unit 39 which is capable of locking the gear 29, and consequently the screw 5, against rotation.

Another motor-speed reducing unit 41 drives in rotation, through the output gear 42 meshed with the ring gear 10, the two cages 6 and 31 and is also capable of acting as a brake for holding the two cages stationary.

Figure 2:
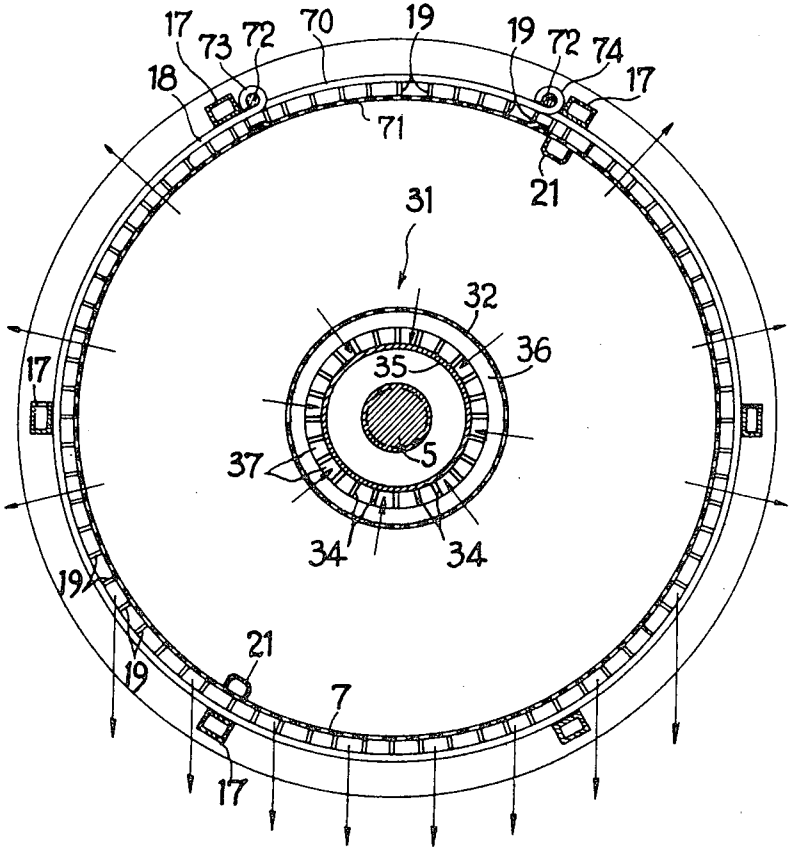
FIG. 2 is a cross-sectional view of the two concentric cages of the press shown in FIG. 1.

The rotational speeds of the screw and cage must of course be different. They are, for example, 12 rpm for the screw and 10 rpm for the cage. The selective control of the two motor-speed reducers 39, 42, which may of course rotate in both directions, permits obtaining multiple combinations and therefore gives a very wide range of speeds for moving in translation the moving plate 22 for pressing the fruit whose juice flows radially, on one hand, outwardly through the perforated wall 7 of the main cage 6 and, on the other hand, inwardly through the perforated wall 32 of the inner cage 31, the longitudinal passages 37 thereafter permitting an axial flow of the juice which issues from the press at the end of the hub 12. This flow of the fractions of juice is indicated by the arrows in FIGS. 1, 2 and 3.

For charging the harvest in the press, the main cage 6 comprises a door 70 (FIG. 2) formed by pervious and detachable panels 71 which are bent in accordance with the curvature of the cylindrical wall 7 and may be fixed in corresponding openings in this wall by means of pins 72 each engaged in an eye 73 which is formed in a ring 18 and is integral with a longitudinal member 17, and in eyes 74 integral with the panels 71.

Figure 3:
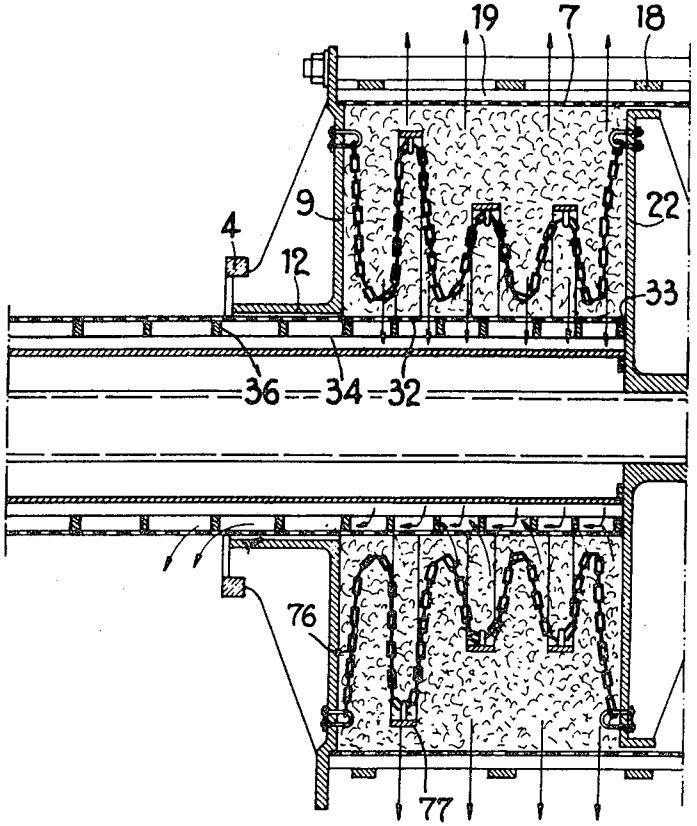
FIG. 3 is a partial axial sectional view of the moving plate of the press in its position at the end of the pressing.

FIG. 3 also shows chains 76 whose ends are respectively secured to the fixed plate 9 and to the moving plate 22 and whose intermediate links are controlled by hoops 77 disposed between the plates. These chains are employed in the known manner for the pressing of the marc.

Having now described my invention what I claim as new and desire to secure by Letters Patent is:

1. A horizontal press for pressing fruit, in particular grapes, comprising a support, two concentric cylindrical cages which are mounted to be rotatable relative to the support and pervious to the juice of the fruit to be pressed, namely an outer cage and an inner cage, means connecting the cages so that they can rotate together, a first plate movable in translation, means connecting the movable plate to the two cages so that it is rotatable with the cages, a second plate which is fixed in translation relative to the support and disposed adjacent an end of the cages opposed to the first plate, the two plates and the two cages defining an annular volume for receiving the fruit to be pressed, a centre screw mounted to be rotatable relative to the support on which screw there is journalled an end of the outer cage opposite the fixed plate, the first plate having a hub screwthreadedly engaged on the screw, the inner cage being integral with the first plate and extending through the second plate, and two independent driving means respectively for driving the screw and for driving both cages.

2. A press as claimed in claim 1, wherein the second plate constitutes one of two end walls which support a cylindrical wall of the outer cage and comprises a hub which defines a cylindrical bore through which bore the inner cage extends.

3. A press as claimed in claim 2, comprising a support cradle and rollers supported by the cradle, the one end wall comprising a runway bearing against the rollers.

4. A press as claimed in claim 2, wherein a bushing is fixed to the screw and the other of said end walls comprises a hub defining a cylindrical bore which is journalled on the bushing.

5. A press as claimed in claim 4, wherein the bushing comprises a flange which forms a thrust bearing for an adjacent end face of the hub of said other end wall.

6. A press as claimed in claim 4, wherein said other end wall carries a ring gear for driving the two cages in rotation.

7. A press as claimed in claim 1, wherein the screw is mounted in cantilever fashion by an outer end of the screw which forms a journal engaged in a bearing of said support.

8. A press as claimed in claim 7, comprising a gear fixed on the screw for driving the screw in rotation.

9. A press as claimed in claim 1, wherein for respectively driving the screw and the cages there are provided two motor-speed reducing units, the motor of each unit being reversible and capable of acting as a brake.

10. A press as claimed in claim 1, wherein the fixed end plate has a hub defining a bore and the inner cage has a cylindrical wall which is in sliding contact with the bore.

11. A press as claimed in claim 10, comprising a cylinder which is fixed to the first plate and constitutes around the screw a sheath which is fluidtight with respect to the juice, the wall of the inner cage having an inner face assembled with said cylinder.

12. A press as claimed in claim 1, wherein the two cages are defined by walls of perforated stainless steel sheet.

* * * * *